United States Patent [19]

Uri

[11] Patent Number: 5,036,786

[45] Date of Patent: Aug. 6, 1991

[54] PATCH SYSTEM FOR SHIP HULLS

[76] Inventor: Joseph Uri, 41 Orange Blossom, Nokomis, Fla. 34275

[21] Appl. No.: 498,174

[22] Filed: Mar. 23, 1990

[51] Int. Cl.[5] ..... B63B 43/16

[52] U.S. Cl. ..... 114/229; 114/227

[58] Field of Search ..... 114/227-229, 114/221, 222, 68; 220/230, 232

[56] References Cited

U.S. PATENT DOCUMENTS

| | | | |
|---|---|---|---|
| 635,939 | 10/1899 | Mason | 114/229 |
| 770,078 | 9/1904 | Kruger | 114/229 |
| 932,720 | 8/1909 | Reinhardt | 114/229 |
| 1,122,047 | 12/1914 | Villiers | 114/229 |
| 1,221,496 | 4/1917 | Wullyamoz | 114/227 |
| 2,240,567 | 10/1939 | Meacham et al. | 114/229 |
| 3,540,404 | 11/1970 | Modrey | 114/229 |
| 3,669,055 | 6/1972 | Buce | 114/229 |
| 4,161,155 | 7/1979 | Cloutier | 114/227 |

*Primary Examiner*—Ed Swinehart

*Attorney, Agent, or Firm*—Gifford, Groh, Sprinkle, Patmore & Anderson

[57] ABSTRACT

A patch or plug repair system for temporarily sealing a rupture in a ship's hull to prevent ingress of sea water or egress of oil. The patch frame utilizes electromagnetic bars to seal a perimeter around the rupture in the longitudinal direction, and resilient gaskets are used at the ends of the frame.

12 Claims, 4 Drawing Sheets

14
86
80
18
32
90
10'
96
24
78
20'
22'
88
97
30
84
82
34
98

PATCH SYSTEM FOR SHIP HULLS

BACKGROUND OF THE INVENTION

1. Field of the Invention

This invention relates to the repair of a ship's hull, and, more particularly, to a system for temporarily patching a leak in a ship's hull to prevent the ingress of sea water into the ship and the egress of a liquid cargo such as oil from the ship.

2. Description of the Prior Art

Various systems have been developed for temporarily sealing holes or leaks in ship's hulls either to prevent the ingress of sea water into the ship or to prevent the egress of the ship's cargo, notably oil, thus leading to sea water contamination, or to seal against both influx and outflow through the leak. The objective in these systems is to temporarily contain the leak until permanent repairs can be accomplished so as to prevent the sinking of the ship by inflow and outflow where more serious damage occurs. With less drastic leaks, damage to the cargo by influx of sea water is of paramount importance, and in the case of tankers, damage to the environment by outflow is to be eliminated or minimized.

Various types of inflatable bladders or concentric inflatable chambers have been used, anchored to the ship by rigging or securing lines. Sometimes a foam blanket is interposed between the bladder or concentric inflatable conduits to be compressed inward into the hole or rupture to effect the seal. Various frame structures have been used to increase the mechanical advantage or sealing pressure around the peripheries of the leak to contain it. Sometimes the leaking oil is drawn off between alternate sealing and collecting chambers.

The usefulness of magnets has been recognized as a means of holding anchoring lines or the patch itself to the steel hull. Likewise, the increased usefulness of electromagnets was recognized in the process of securing the patch device so that the patch could be positioned over the leak by divers or positioning gear, and once positioned, the current could be applied to the electromagnet to effect the attraction and holding of the patch or lines to the steel hull.

In containing larger leaks, combinations of inflatable elements, canvas type curtains, sustaining weights and spaced magnets have been used to form a type of cofferdam confining the leak area so that leaking oil may be drawn off before it contaminates the sea water.

With smaller leaks, electromagnets have been arranged in a spaced circular pattern around a patch material to temporarily hold the patch against the hull until a marine glue or adhesive sets up. Somewhat larger leaks have been contained with circular patterns of spaced magnets used with a canvas structure and reinforcing bars along with pressure tubes for sealing or discharge tubes to draw sea water or leaking oil away. Permanent magnets have also been used around three sides of a rectangular periphery to hold a water proof curtain against the ship hull to a point above the water line.

SUMMARY OF THE INVENTION

It is to a more expeditious use of electromagnets and cooperating elements in a system for patching a leak in a ship hull that the present invention is directed. The present invention is directed to a system for applying a patch for temporarily sealing a leak to prevent the egress or influx of water into the ship and to a system employing a patch or plug for temporarily sealing the leak to prevent the egress or outflow of a liquid cargo such as oil which would contaminate the sea water and surrounding environment.

The system of the invention utilizes a generally rectangular frame member having longitudinal sides for arrangement parallel to the ship length and parallel ends for arrangement extending toward the ship bottom and deck. An electromagnetic bar extends along and adjacent each longitudinal side of the frame member for direct contact with the ship's hull, and preferably a resilient gasket extends along and adjacent each end of the frame for direct contact with the hull. The metal to metal contact of the frame which includes the electromagnetic bars along with the contact of the resilient gaskets seals a perimeter of the frame against the hull around a leak in ship's hull when the frame is positioned over the leak and the electromagnetic bars are energized.

The frame member includes a metal plate which is recessed to receive the electromagnetic bar flush with the surface of the plate. In one embodiment, hinges are supplied along at least one of the longitudinal sides of the plate, outboard of the magnetic bar for attaching to a similar plate for forming the composite frame member. With this hinge structure and the electromagnetic bars extending along the longitudinal side of the ship, the frame can flex at the hinges to seal around the perimeter of the leak by the metal to metal contact of the frame including the magnetic bars. Preferably longitudinally extending recesses are provided in each of the plates adjacent to the hinge so that a resilient gasket can be seated in the recess when the plates are hinged together to effect a seal between plates and at the ends of the plates to conform to the contour of the ship hull. In a preferred form of this hinged design which is used as a plug to confine oil spillage from within the ship, the ends of the plates are recessed to receive a resilient gasket along the entire end of each plate to conform with the contour of the ship hull.

For temporarily sealing a leak even in large areas to prevent the ingress of sea water into the ship, the frame member includes a stiffening plate along each longitudinal side of the frame. One of the surfaces of the plate contains the recess to receive the longitudinally extending electromagnetic bar. A rectangular steel sheet is attached to the other side of the stiffening plate with a steel mesh blanket extending coextensively with the sheet and interposed between the surface of the stiffening plates which both the steel sheet and steel mesh blankets are attached. This give considerable flexibility to a relatively large patch frame so that sealing around the perimeter of the frame is effected between a metal to metal contact of the frame including the electromagnetic bars and flexible or resilient gaskets which extend between the stiffening plates.

In a preferred embodiment of this patch, the stiffening plates form the crossbars of inverted T-sections with the recess and electromagnetic bar being located in the crossbar of the T-section with the steel sheet and steel mesh blanket being attached to the underside of the crossbar of the T-section. Additionally, a resilient gasket can be used between the steel sheet and the crossbar of the T-section.

In all of the foregoing embodiments, lifting eyes are used in the frames or the hinged plates to receive cable fasteners of the cables. Preferably these cables extend from a portable crane or winch mechanism at opposite sides of the ship to the frame. By extending the cables from one crane and retracting the cables at the other crane the patch or plug can be positioned relative to the damaged or leak area of the ship. When the patch has been properly located to surround the leak area, the electromagnetic bars are energized to complete the seal around the perimeter of the frame and the leak.

DRAWING

The preferred embodiments of the invention are illustrated in the drawing in which.

DETAILED DESCRIPTION OF THE PRESENTLY PREFERRED EMBODIMENT

Figure 1:
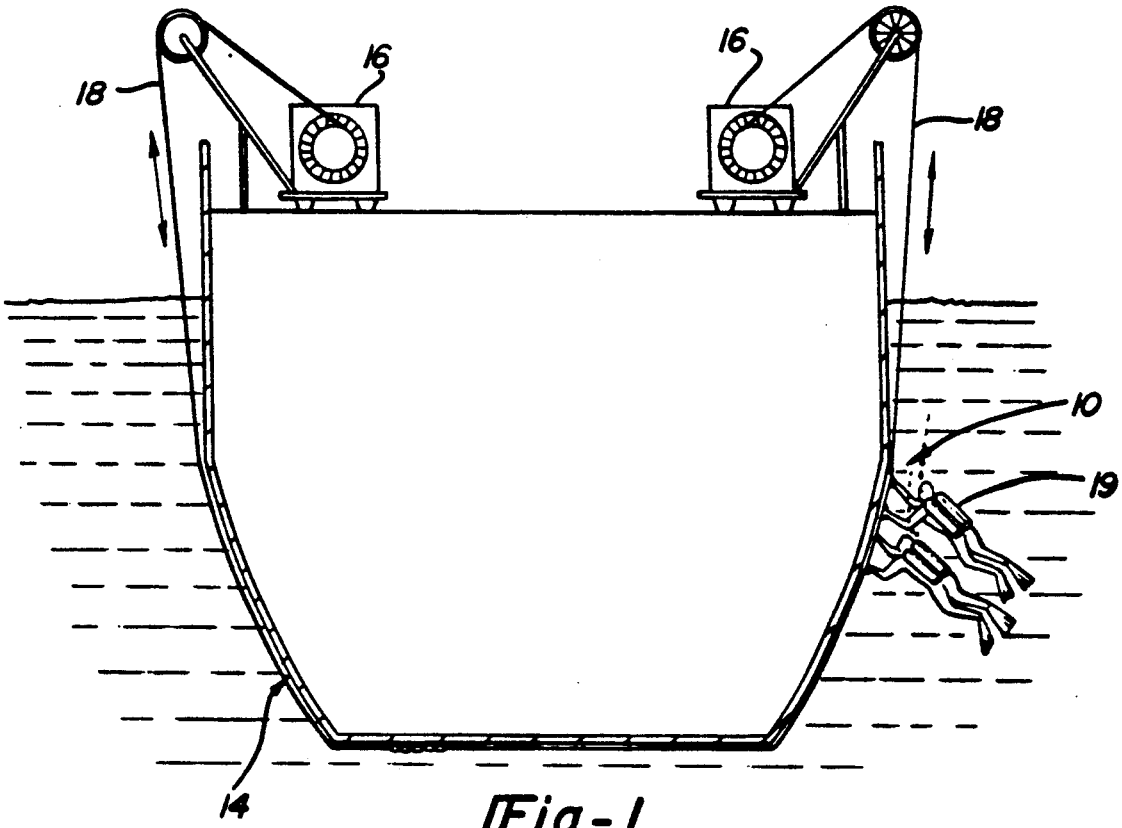
FIG. 1 is a diagrammatic cross-sectional view of a ship hull taken in the direction of the ship's beam and illustrating a patch being applied to the outside surface of the hull in accordance with the present invention.
Figure 2:
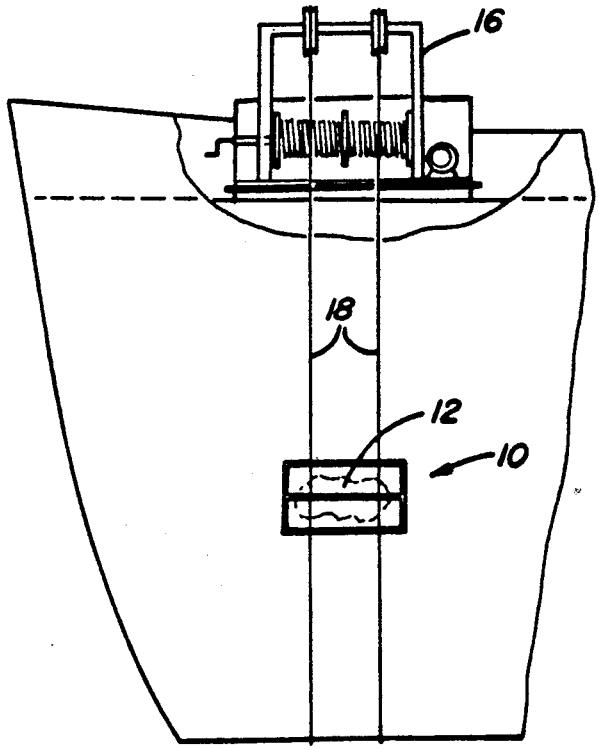
FIG. 2 is a diagrammatic side elevation similar to FIG. 1 of the stern end portion of a ship hull showing the perimeter of the patch surrounding the hole or rupture which created the leak in the hull.

Referring to FIGS. 1 and 2 of the drawings the leak through a hole in the hull 14 of a ship can be temporarily repaired by the patch or plug system 10 of the present invention which is positioned over the hole 12 by operation of portable cranes 16 in conjunction with securing cables 18 which in their most utilitarian mode extend from movable cranes 16 located at opposite sides of the ship hull 14. The cables 18 are fixed to the patch or plug system 10 and are manipulated by means of the cranes 16 so that a hole anywhere on either side of the ship's hull or bottom can be repaired by proper location of the patch system 10. Divers indicated at 19 may properly locate the patch system 10 and other auxiliary equipment may be utilizewd to position the patch.

Figure 3:
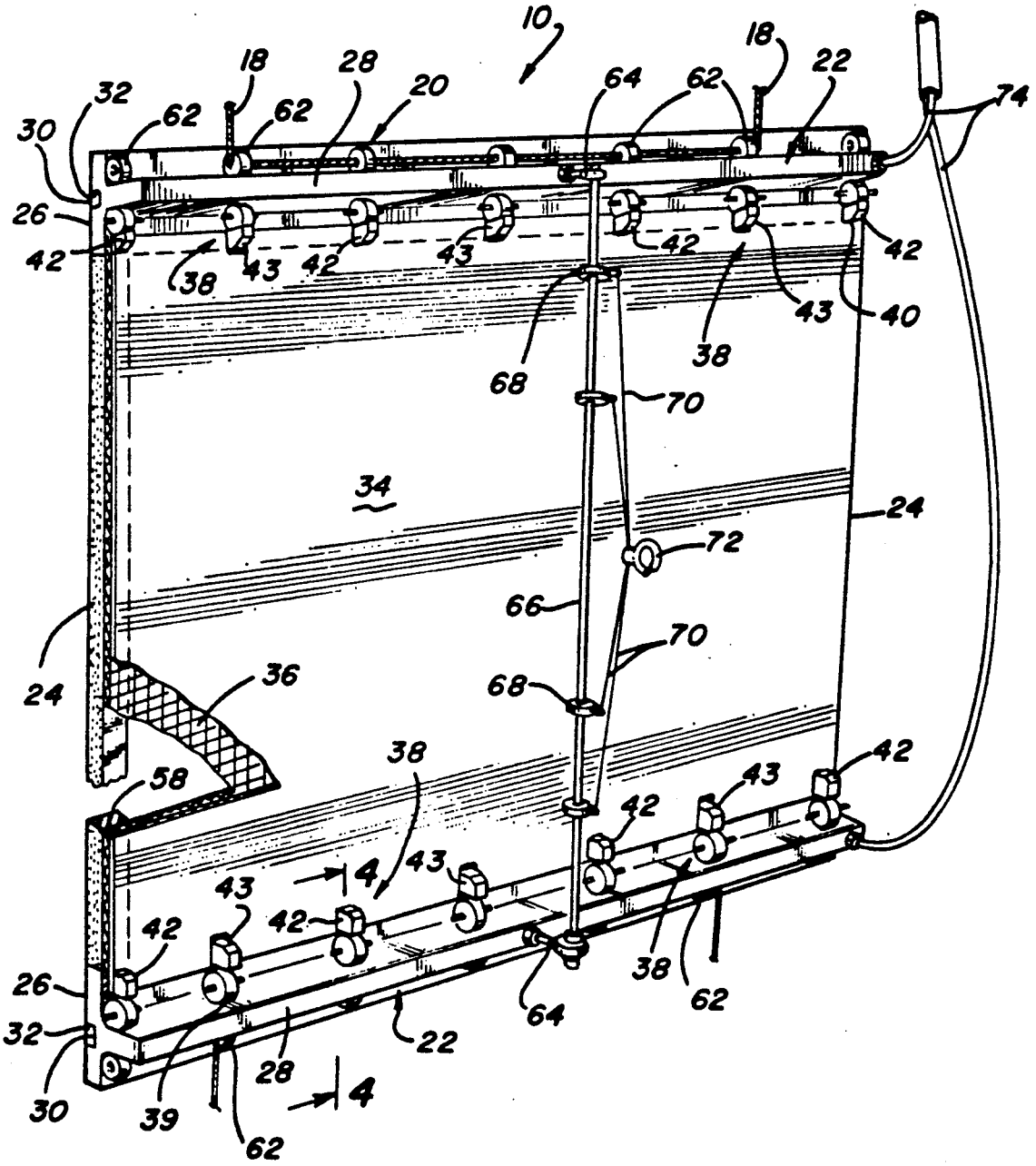
FIG. 3 is a generally planar perspective view with a portion broken away of the patch construction used in the system of this invention for temporarily patching a leak in a ship hull; this embodiment being particularly structured to prevent the ingress of sea water into the ship.
Figure 4:
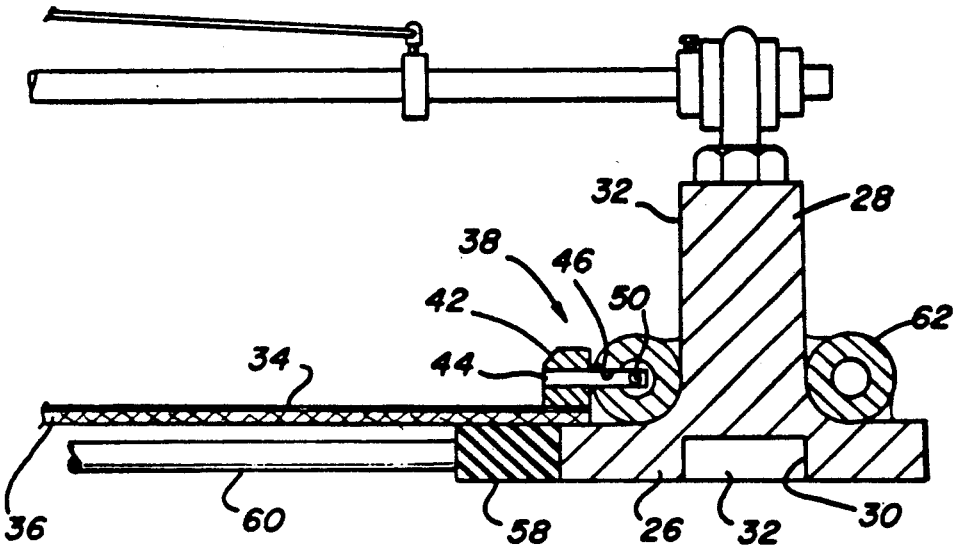
FIG. 4 is a cross-sectional view taken along line 4—4 in FIG. 3 showing the T-section which extends longitudinally along each side of the frame member; this view shows the attachment of a rectangular steel sheet and the steel mesh blanket to the crossbar of the T-section.
Figure 5:
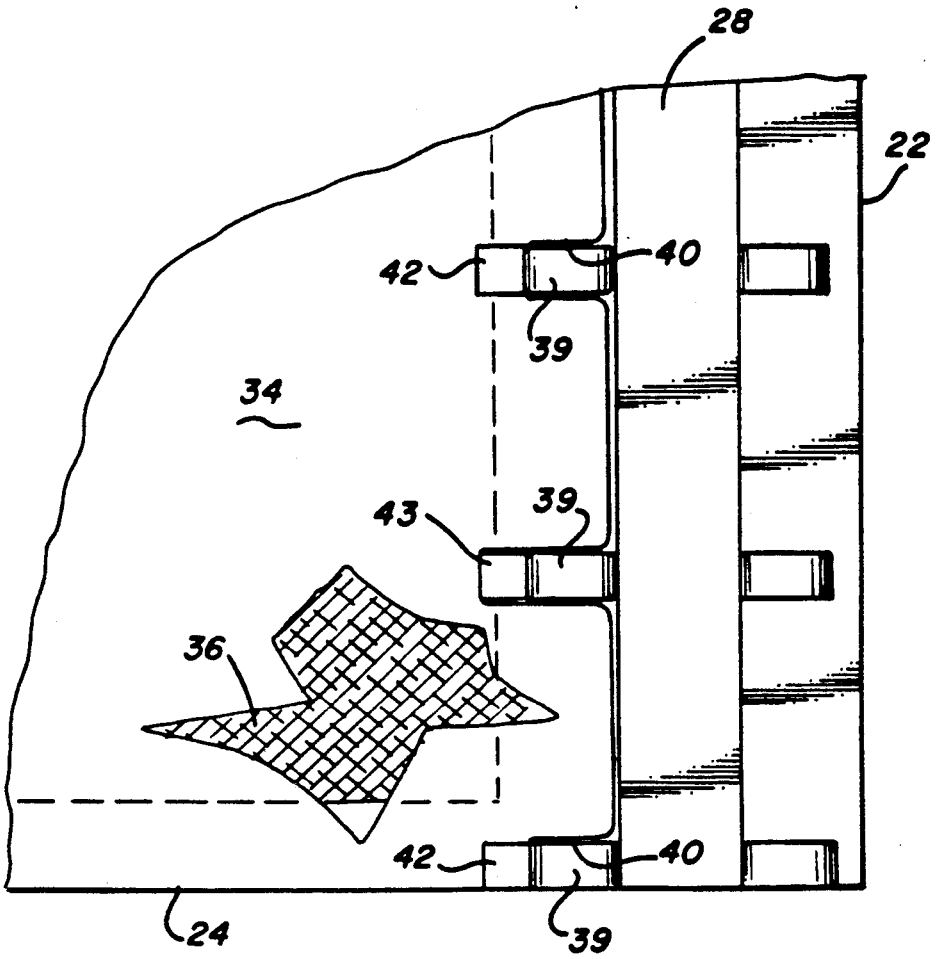
FIG. 5 is a top plan view of the showing in FIG. 4 showing further details of the attachment of the steel sheet and the steel mesh blanket to the T-section.

Referring to FIGS. 3–5, and particularly to FIG. 3, the patch repair system 10 of the invention is a generally rectangular member 20 which has longitudinally extending opposite sides formed by T-sections 22 for arrangement parallel to the ship length and parallel ends or edge portions 24 for arrangement extending generally vertically toward the ship bottom and deck. The crossbar 26 of the T-section forms the longitudinally extending edge plates of the frame 20 which is stiffened by the stem 28 of the section to create sturdy sides which will not be subjected to warpage. The length of the T-section is preferably selected to be of a length sufficient to bridge the hole 12 in the hull 14.

A recess 30 is cut into the crossbar 26 opposite stem 28 to provide for flush mounting of an electromagnetic bar 32. A steel sheet 34 extends between the crossbar plates 26 and together with a steel mesh blanket 36 is attached to the underside of the crossbar 26 by locking assemblies 38 which extend along both longitudinally extending sides of the frame member 20. Both the steel sheet and the steel mesh blanket preferably are made of stainless steel.

The locking assemblies 38 each include a pipe ring member 39. A plurality of such pipe ring members 39 are uniformly spaced from each other at opposite sides of the stem 28 of the T-member. The sheet 34 is provided with marginal recesses 40 and 41 to receive the pipe ring members 39. Lugs 42 are welded directly to the sheet 34 at the ends of recesses 40. The recesses 41 are slightly deeper than recesses 40 to expose the mesh 36 below and receive lugs 43 similar to lugs 42 which are fixed directly to the steel mesh layer 36 by welding. As a result locking assemblies 38 include lugs 42 and 43 which alternately are welded to the steel sheet 34 and steel mesh 36, respectively. Each of the lugs 42 and 43 have a shank portion 44 which fits through an aligned hole 46 in pipe ring member 39 which is welded as shown to the crossbar 26 and stem 28 of the T-section 22.

In assembling the steel sheet and steel mesh blanket to the T-sections the shanks 44 are inserted through the holes 46 in the pipe ring sections and assembled thereto by the use of a cross-pin 50 which slides through a corresponding aperture in the shank 44 as best seen in FIG. 4.

In assembling the sheet 34 and mesh blanket 36 to the T-section frame members 22 resilient gaskets 58 made of rubber, neoprene or other suitable resilient material are inserted between adjacent pipe ring members 48 and between the sheet 34 and the underside of the crossbar section 26 so as to seal the sheet 34 along its complete longitudinal edge to the crossbar 26. A resilient gasket of similar material can be inserted at each end 24 of the frame 20 to extend between the inner end of the crossbars 26 to completely seal the perimeter of the sheet 34 and mesh 36 to the ship hull 14.

Rods 60 can be provided with the ends connected to the ends of the opposed crossbars 26 to facilitate handling until the plug 10 is suspended from cables 18 over the side of the ship. Thereafter the rods 60 can be removed.

Pipe rings 62 similar to pipe rings 39 are welded to the other side of T-sections stem 28 and crossbar 22 to provide for the addition of sheets 34 and mesh 36 to enlarge the plug 10. If not used for that purpose, the pipe rings 62 form lift rings for manipulating the patch system 10 in position on the outside of the ship.

Stanchions 64 are mounted midway between frame member ends 24 on the T-section stem 28 to mount a crossbar 66, cable rings 68, cables 70 and lifting eye 72 for moving the patch 10 parallel to the ship deck before attachment to the winches. The crossbar 66 and associated parts can be removed before final location of the patch.

In operation, after the damaged area has been located, the hull is prepared by scraping off any barnacles in the repair area and the patch repair system 10 is moved by lifting eye 72 to the deck position for lowering over the side of the ship by securing lines or cables 18. Once the patch repair system 10 has been located so that the perimeter of the rectangular frame member 20 surrounds the hole or damaged area 12, power is supplied to the electromagnetic bars 32 through cables 74 from power supply 76 to energize the electromagnetic bars 32 to pull the patch securely in place against the hull making a metal to metal contact along the longitudinal sides of the frame at the crossbars 26 and flush mounted electromagnetic bars 32 and the resilient gasket 58 along the ends 24 of the frame 20. Patch 10 is particularly suitable for temporary repair of cracks or punctures in a ship's hull to prevent leakage of sea water into the ship.

Figures 6, 7, 8:
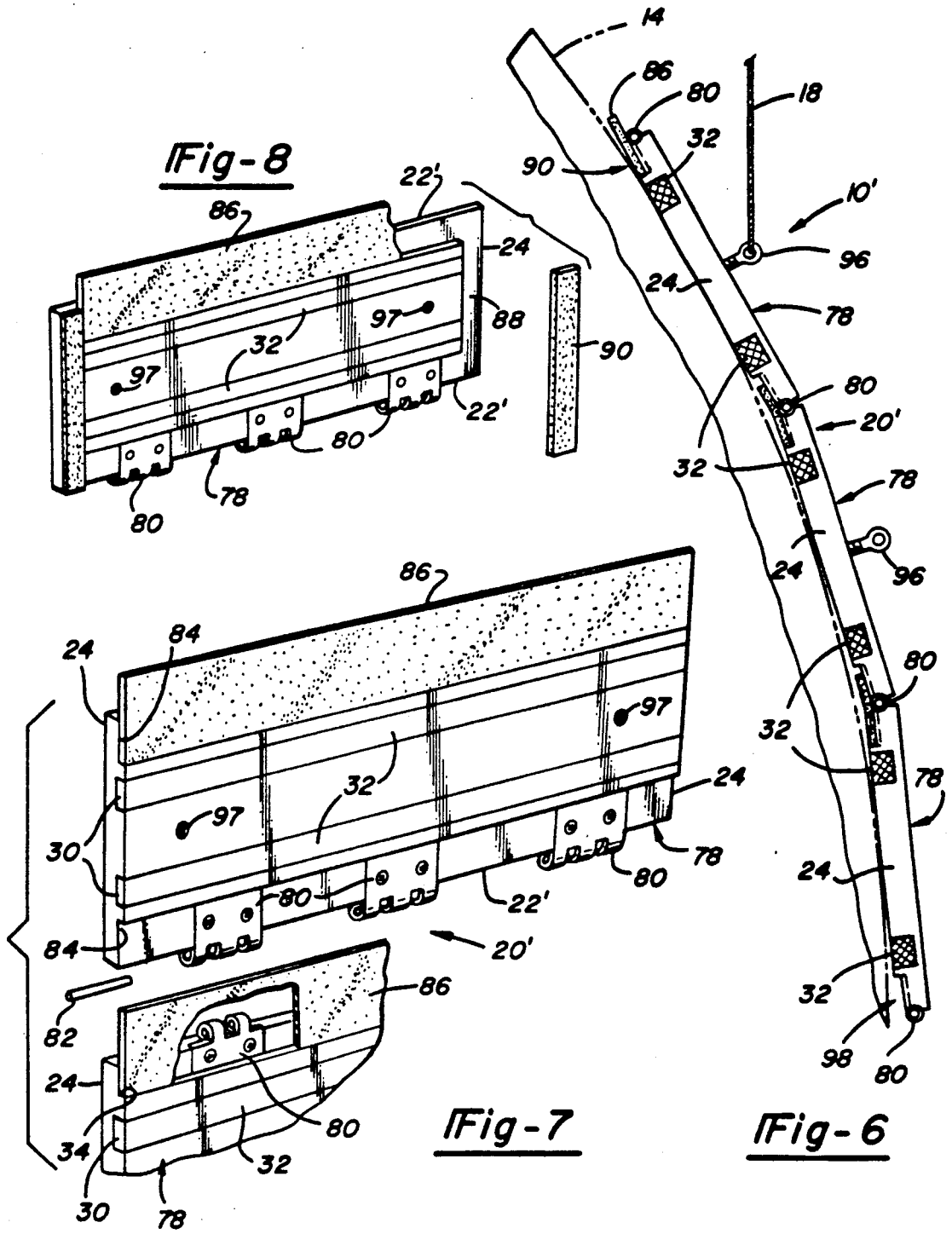
FIG. 6 is an end view of another embodiment of the invention showing the application of a plug to the ouside surface of the hull to prevent the agress of a liquid cargo from the ship.
FIG. 7 is an exploded perspective view of the plug of FIG. 6 showing the hinge connection of the rectangular plates together to form the frame member of the patch.
FIG. 8 is an exploded perspective view of a further modification of the plug of FIG. 6 showing the application of a resilient gasket in the recesses adjacent to the ends of the plate.

In the embodiment shown in FIGS. 6 and 7 the plug repair system 10' comprises one or more plates 78 which singularly or in combination with other plates 78 consitute the rectangular frame member 20' of the plug. Each plate 78 has longitudinally extending sides 22' for alignment with the length of the ship and ends 24 which extend toward the bottom and deck of the ship. Parallel recesses 30 receive the electromagnetic bars flushly mounted. When the frame member 20' constitutes a single plate 78 for covering a hole or rupture that has a small depth dimension the plate 78 can be centered over the rupture and the metal to metal contact of the plate 78, which constitutes the frame member 20, including the electromagnetic bars 32 seals the perimeter of the frame around the leak when the electromagnetic bars are energized.

As shown in FIG. 6, several plates 78 may be hinged together to form a frame member 20' which is large enough to cover a rupture in the hull having a larger depth dimension. To accomplish this, hinge members 80 are recessed into the plates 78 adjacent their longitudinal edges 22' to be joined by hinge pins 82 as indicated in FIG. 7. Recesses 84 are provided in the plates 78 outboard of the recesses 30 for electromagnetic bars extending to the edges 22' to accommodate a resilient sealing gasket 86 which not only will seal the ends 24' of the frame member but also extend the entire longitudinal length of the plates 78 for sealing contact with the ship hull 14 when the electromagnetic bars 32 are energized.

In a preferred form of the invention shown in FIG. 8 the opposite ends of the plate 78 are recessed at 88 to receive resilient gasket 90 along frame ends 24. This will provide gasket sealing around the perimeter of the frame member 20'.

Lifting eyes 96 best seen in FIG. 6 are provided in the top of plates 78 at selected locations indicated at 97 in FIGS. 6 and 7 to accommodate the securing lines 18.

The plug repair system 10' of FIGS. 6–7 is particularly adapted for sealing a leak in the hull 14 to prevent the egress or outflow of a liquid cargo such as oil from the ship.

The embodiments of the invention in which an exclusive property or privilege is claimed are defined as follows:

1. A system for patching a leak in a ship hull comprising:

a generally rectangular frame member having longitudinal sides for arrangement parallel to the ship length and parallel ends for arrangement extending vertically of the ship hull;

an electromagnetic bar extending along and adjacent each longitudinal side of said frame member for direct contact with said hull, said frame member including a metal plate recessed to receive said electromagnetic bars flush with a surface of said plate; and a resilient gasket means extending along and adjacent each end of said frame for direct contact with said hull;

metal to metal contact of said frame including said electromagnetic bars along with contact of said resilient gasket means sealing a perimeter of said frame against said hull around a leak in the ship hull when said frame is positioned over said leak and said electromagnetic bars are energized.

2. The system according to claim 1 further including hinge means along at least one longitudinal side of said frame member, outboard of said magnetic bar for attaching another frame member.

3. The system according to claim 2 including a recess along a longitudinal side having said hinge means and said resilient gasket means including a resilient gasket in said recess for sealing against said hull between adjacent frame members hinged together.

4. The system according to claim 2 including a recess along each end of said frame member and wherein said resilient gasket means includes a resilient gasket in each of said recesses.

5. The system according to claim 1 wherein said frame member includes a stiffening plate along each longitudinal side, said plate having parallel mounting surfaces, one of said mounting surfaces containing a recess to receive said electromagnetic bar, and a rectangular steel sheet attached adjacent one of its sides to the other of said mounting surfaces.

6. The system according to claim 5 further including a steel mesh blanket coextensive with said rectangular steel sheet and interposed between said steel sheet and one of said mounting surfaces of each of said stiffening plates.

7. The system according to claim 6 wherein each of said stiffening plates forms the crossbar of an inverted T-section with said recess and electromagnetic bar being located in the crossbar of said T-section and one side of said steel sheet being fastened with said steel mesh blanket to the underside of the crossbar of said T-section.

8. The system according to claim 7 wherein said resilient gasket means includes a resilient gasket between said steel sheet and the crossbar of said T-section.

9. A patch for temporarily sealing a leak in a ship hull to prevent ingress of sea water into the ship comprising:

a pair of longitudinally extending spaced T-sections each having a crossbar and a stem portion, said T-sections being arranged parallel to each other, the crossbars of said T-sections constituting the longitudinal sides of a rectangular frame member, each of said crossbars containing a recess located parallel to said stem portion;

an electromagnetic bar in each of said recesses extending substantially the length of said T-section;

a rectangular steel sheet having parallel ends extending between said T-sections and having parallel longitudinal sides attached to said crossbars;

a rectangular steel mesh blanket coextensive with said rectangular steel sheet interposed between said steel sheet and said crossbars and being attached to said crossbars; and a resilient gasket extending between said crossbars adjacent the ends of said rectangular steel sheet and in sealing abutment with said rectangular steel sheet;

metal to metal contact of said frame member including said electromagnetic bars and contact of said resilient gasket means sealing a perimeter of said frame against said hull around a leak in said ship hull when said frame is positioned over said leak and said electromagnetic bars are energized.

10. A plug for temporarily sealing a leak in a ship hull to prevent egress of liquid cargo from the ship comprising:

at least a pair of rectangular plates, each said rectangular plate having longitudinal sides and ends and a pair of parallel recesses, one recess adjacent each longitudinal side;

an electromagnetic bar in each of said recesses mounted flush with a surface of said plate for metal to metal contact of said plate and electromagnetic bars with said ship hull; and hinge means along at least one longitudinal side of each of said plates, said plates being hinged together along said hinge means and together constituting a frame member which seals around its perimeter against said hull around a leak in the ship hull when the frame member is positioned over said leak and said electromagnetic bars are energized.

11. The plug according to claim 10 wherein each of said plates has a recess along each end of said plate and a resilient gasket is located in each of said recesses whereby said frame member seals around its pereimeter to said hull by metal to metal contact of said magnetic bars and contact of said resilient gaskets against said ship hull.

12. A plug according to claim 11 further including a recess along the longitudinal sides of said plates having said hinge means and a resilient gasket extending within each of said recesses for sealing against said hull between adjacent plates forming said frame member.

* * * * *